US007690702B2

(12) United States Patent
Bohme

(10) Patent No.: US 7,690,702 B2
(45) Date of Patent: Apr. 6, 2010

(54) LOCK BAR FOR RAILROAD GATE WARNING MECHANISM

(75) Inventor: Richard C. Bohme, Louisville, KY (US)

(73) Assignee: Safetran Systems Corporation, Louisville, KY (US)

( * ) Notice: Subject to any disclaimer, the term of this patent is extended or adjusted under 35 U.S.C. 154(b) by 15 days.

(21) Appl. No.: 11/241,134

(22) Filed: Sep. 30, 2005

(65) Prior Publication Data

US 2007/0075193 A1 Apr. 5, 2007

(51) Int. Cl.
*E05B 3/00* (2006.01)
*E05B 1/00* (2006.01)

(52) U.S. Cl. ..... 292/336.3; 292/347; 292/DIG. 27

(58) Field of Classification Search ..... 292/336.3, 292/347, 348, DIG. 27; 16/62, 79, 354; 81/60–63.1; 74/526, 527, 575; 192/223, 223.2; 246/125–127, 246/292, 293, 473.1
See application file for complete search history.

(56) References Cited

U.S. PATENT DOCUMENTS 1,171,124 A * 2/1916 Hoeschen ..... 246/263
1,366,134 A * 1/1921 Rome ..... 246/293
1,421,251 A * 6/1922 Kennedy ..... 246/293
1,442,703 A * 1/1923 Sawicki ..... 246/293
3,255,647 A * 6/1966 Gray ..... 81/63.1
3,477,299 A * 11/1969 Simmons et al. ..... 74/10.41
3,727,886 A * 4/1973 Cain ..... 254/369
3,742,788 A * 7/1973 Priest ..... 81/61
3,939,729 A * 2/1976 Brockelsby ..... 74/575
4,468,005 A * 8/1984 Nakamura ..... 254/350
6,263,767 B1 * 7/2001 Hu ..... 81/60
6,726,419 B2 * 4/2004 Benedetti et al. ..... 411/377
7,051,623 B2 * 5/2006 Chaconas ..... 81/60
7,055,409 B2 * 6/2006 Hsien ..... 81/60
7,128,307 B2 * 10/2006 Dow ..... 254/342

OTHER PUBLICATIONS

INVENSYS—Application Guidelines, Microprocessor Based Grade Crossing Predictor Model 3000 Family.
Safetran Systems Corporation, Instruction & Installation, Solid-State Crossing Controller III Plus (SSCC 111 Plus) 91190, 91195, Apr. 2004, Document No. SIG-00-02-03, Version D.
Safetran Systems Corporation, Instructions & Installation, Microprocessor Based Grade Crossing Predictor Mode; 3000 Family, Apr. 2002, Document No. SIG-00-00-02, Version B.

* cited by examiner

*Primary Examiner*—Carlos Lugo
(74) *Attorney, Agent, or Firm*—Cook Alex Ltd.

(57) ABSTRACT

A lock bar for controlling the position of a railroad warning gate includes an elongated body portion extending between a first end and a second end, a clutch mechanism disposed in the elongated body, the clutch mechanism permitting rotational movement in one direction but restricting rotational movement in the opposite direction and a hub disposed in the clutch mechanism for engaging a portion of a motor drive mechanism for a railroad warning gate such that the gate is permitted to move in one direction but is restricted from movement in the opposite direction. Indicia are preferably disposed on the opposing edges to indicate the position that the warning gate will be retained in. An oblong aperture defined through the lock bar receives a pin to hold the lock bar in engagement with the motor drive mechanism.

14 Claims, 4 Drawing Sheets

LOCK BAR ORIENTATION FOR KEEPING GATE UP

LOCK BAR ORIENTATION FOR KEEPING GATE DOWN

LOCK BAR FOR RAILROAD GATE WARNING MECHANISM

FIELD OF THE INVENTION

The present invention relates generally to apparatus for locking the gear train of a gate warning mechanism at a railroad crossing. More particularly, the present invention relates to improved apparatus that provides for positive locking of the gear train of a warning gate mechanism in a selected direction of movement.

BACKGROUND OF THE INVENTION

FIGS. 1 and 2 illustrate a prior art lock bar 20, which is located in a warning gate control box, generally designated 21. A box or housing 21 has a cover 27 which may be opened to access internal components. Lock bar 20 is used to lock the gear train 22 of a gate mechanism 23 from moving while a maintainer installs a gate arm 33, such as in FIG. 4, to a conversion bracket or to a gate adaptor 24. Lock bar 20 consists of a steel angle bar that is secured to a pin 25 on a bracket 26 for rotational movement about pin 25. One end 28 of the lock bar 20 can be manually operated to catch in the teeth of a pinion gear 30 of the motor 32 (FIG. 4) to prevent rotation of the gear train 22 and, hence, of the gate arm 33. However, lock bar 20 may be used to restrict gear rotation in only one direction. If a maintainer lifts up on the gate while installing it, the lock bar 20 may become dislodged from the teeth of pinion gear 30, and the gear train 22 will then be free to rotate, including the gate arm 33.

This prior art lock bar 20 requires the maintainer to press a maintenance button located in the gate control box 21 and release it when the gate 33 is in the desired or required position. The end 28 of the lock bar 20 must then be quickly inserted into the teeth of the pinion gear 30 to prevent rotation. The mass of the counterweights 35 located on one end of the gate 33 exerts a force back through the gear train 22 keeping the lock bar 20 wedged in the teeth of the pinion gear 30. Insertion of the lock bar 20 into the teeth of pinion gear 30 is rather tricky because the pinion gear 30 is often in motion. This can present a potential hazard if the lock bar 20 is used incorrectly or if it becomes disengaged.

As can be appreciated from FIG. 1, the lock bar 20 is rotated on the pivot pin 25 until the flat on the end 28 of the lock bar 20 settles in the teeth of pinion gear 30. This "jamming operation" is frequently done with the gear 30 still moving. Any external force applied to the gate arm 33 or to the main shaft 24 (FIG. 4) in the opposite direction will tend to force or push the lock bar 20 out of engagement with the teeth of gear 30. When the maintenance is completed, the lock bar 20 can be removed from pin 25 at the slotted key hole area 29, and repositioned with the enlarged portion of the slotted key hole 29 placed over bolt head 34 such that a slot 31 in end 28 of lock bar 20 rests against pin 25.

A general object of the present invention is to provide an improved lock bar for restricting or limiting movement of a railroad crossing warning gate during maintenance.

Another object of the present invention is to provide a lock bar for restricting or limiting movement of a railroad crossing warning gate in either the up position or in the down position.

A further object of the present invention is to provide a lock bar in the form of a handle with a clutch assembly that permits rotation in one direction, but that restricts or limits rotation in an opposite direction.

Yet another object of the present invention is to provide a lock bar that must be removed when maintenance is completed and before a cover of the gate control box can be closed.

SUMMARY OF THE INVENTION

The present invention is directed to a lock bar for controlling the position of a railroad warning gate. The warning gate is moveable from a raised position to a lowered position by a motor drive mechanism. The lock bar includes an elongated body portion extending between a first end and a second end, a clutch mechanism disposed in the elongated body, the clutch mechanism permitting rotational movement in one direction but restricting rotational movement in an opposite direction and means disposed in the clutch mechanism for engaging a portion of the motor drive mechanism such that the railroad warning gate is permitted to move in one direction but is restricted from movement in the opposite direction. The means in said clutch mechanism for engaging a portion of the motor drive mechanism may include an internal hexagonal female surface for engaging a hexagonal shaft on the motor drive mechanism.

The lock bar includes opposing edges disposed along the elongated body portion, and preferably includes indicia disposed on a first of the opposing edges for indicating a first position that the warning gate will be retained in if the lock bar is installed on the motor drive mechanism with the first opposing edge in a generally upright manner. Preferably, the lock bar also includes indicia disposed on a second of the opposing edges for indicating a second position that the warning gate will be retained in if the lock bar is installed on the motor drive mechanism with the second opposing edge in a generally upright manner. For example, the first position of retaining the railroad warning gate may be an up position and the second position may be a down position.

The lock bar may also include an aperture defined through the lock bar, the aperture suited for receiving a pin of the motor drive mechanism therethrough to hold the lock bar in engagement with the motor drive mechanism. The aperture may be in the form of an oblong slot. The lock bar may include a lanyard, with a first end of the lanyard secured to the lock bar, and with a second end of the lanyard including means to mate the lanyard with the pin of the motor drive mechanism to secure the lock bar about the pin. The means to secure the lanyard to the pin may be a hairpin or a cotter key.

The motor drive mechanism is provided with a housing, including a cover for enclosing the motor drive mechanism. The lock bar is preferably of sufficient length between the first and second ends to prevent closure of the cover of the housing while the lock bar remains engaged with the motor drive mechanism.

BRIEF DESCRIPTION OF THE DRAWINGS

The invention, together with its objects and the advantages thereof, may best be understood by reference to the following description taken in conjunction with the accompanying drawings, in which like reference numerals identify like elements in the figures, and in which.

DESCRIPTION OF THE PREFERRED EMBODIMENTS

It will be understood that the invention may be embodied in other specific forms without departing from the spirit thereof. The present examples and embodiments, therefore, are to be considered in all respects as illustrative and not restrictive, and the invention is not to be limited to the details given herein.

Figure 1:
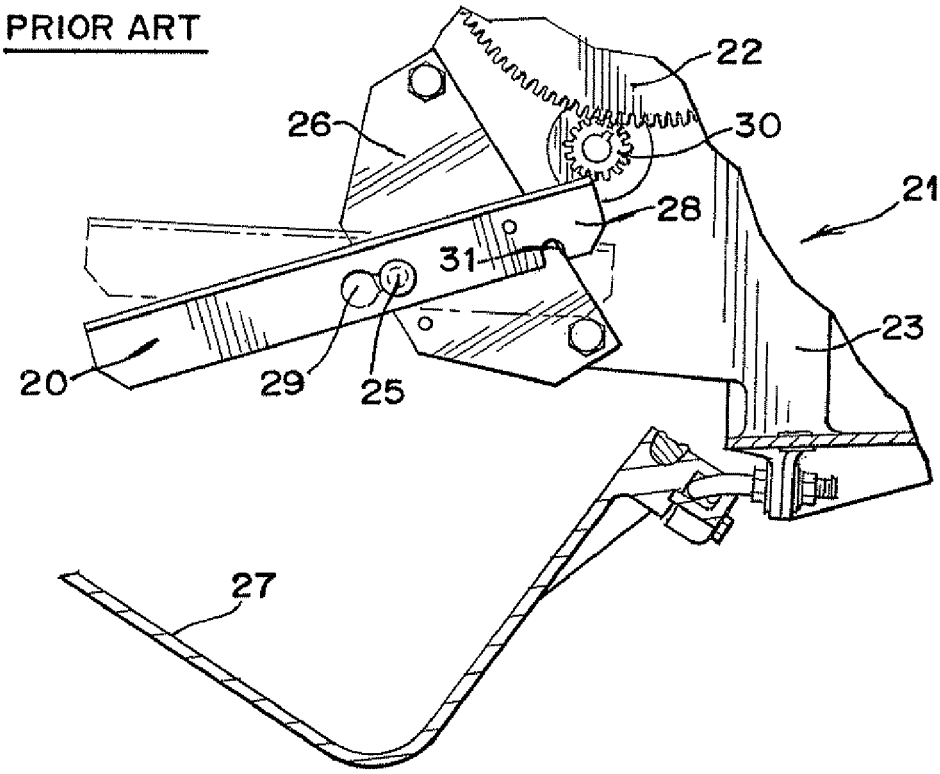
FIG. 1 PRIOR ART
FIG. 1 is a partial elevational view, taken in cross-section through the gate control box, illustrating a prior art technique of locking the gear train of the gate mechanism with a lock bar to hold the gate in a desired position during maintenance.
Figure 2:
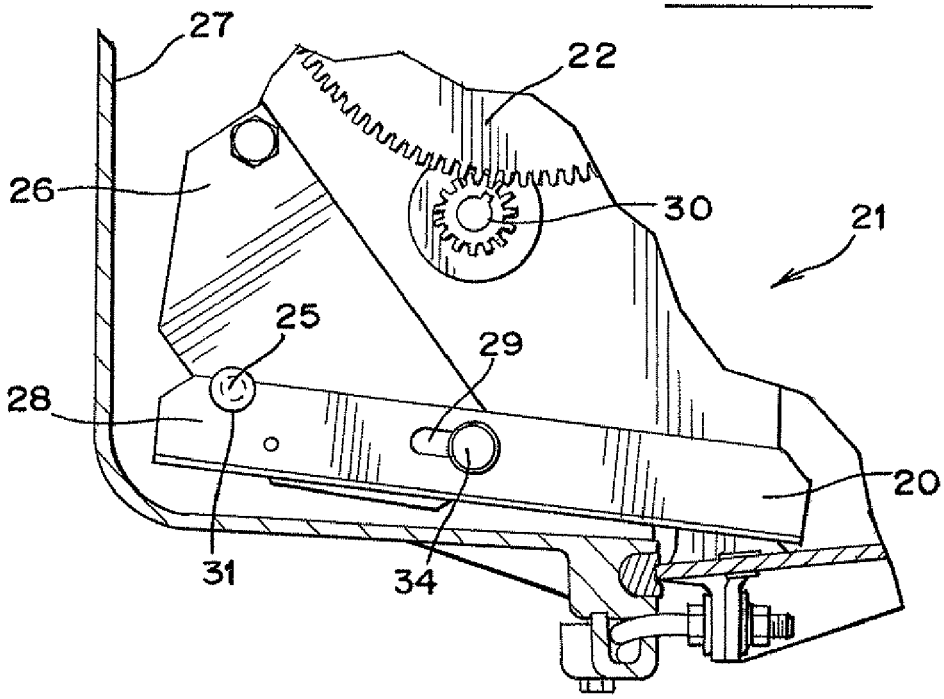
FIG. 2 PRIOR ART
FIG. 2 is also a partial elevational view, taken in cross-section through the gate control box, illustrating the prior art lock bar of FIG. 1 stored in the gate control box when not in use.
Figure 3:
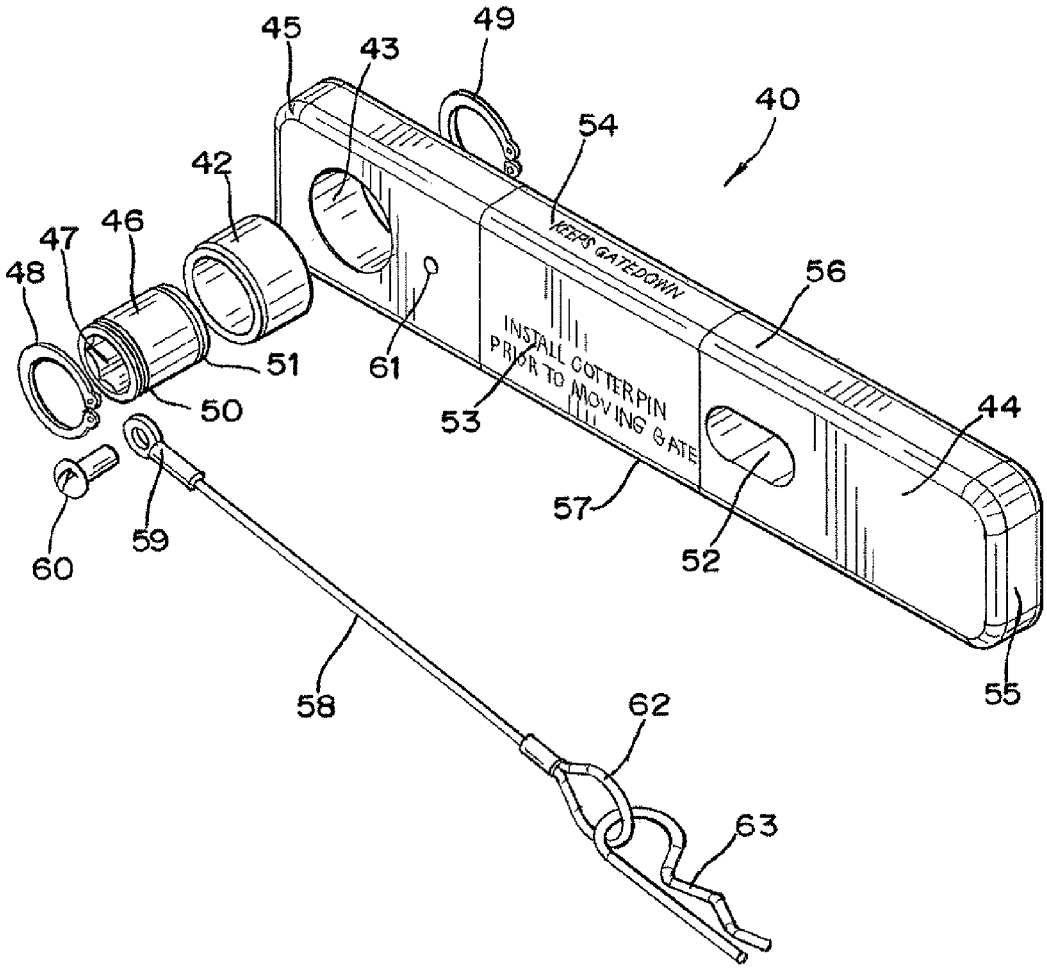
FIG. 3 is a perspective exploded view which illustrates the various components of the lock bar of the present invention.

With reference to the drawing Figures, FIG. 3 illustrates an exploded view of a bi-directional lock bar 40 of the present invention. This lock bar 40 uses an over running bearing/clutch assembly 42 that prevents rotation in one direction but that permits rotation in an opposite direction, such as in the manner of a ratcheting mechanism. This ratcheting assembly 42 is installed in an aperture 43 defined near a first end 45 of the handle 44. A hub 46 fits concentrically and axially within the clutch assembly 42. Hub 46 may have a hexagonal interior female portion 47. Both the clutch assembly 42 and the hub 46 are retained within the aperture 43 of handle 40 by snap rings 48 and 49 disposed in grooves 50 and 51 defined about the outer periphery of hub 46.

A lanyard 58 is used to secure the lock bar 40 in an operational position, as will be further appreciated below. Lanyard 58 has an eyelet end 59 that may be secured to lock bar 40, as by a threaded fastener 60 in an aperture 61. Lanyard 58 also has an opposite loop end 62 for receiving a hairpin 63 therethrough. Hairpin 63 may alternatively be in the form of a cotter key or other suitable retaining means. An oblong hole or slot 52 is further defined through lock bar 40 at an intermediate position between the first end 45 and the second end 55. The use of slot 52 is presented below.

Figure 4:
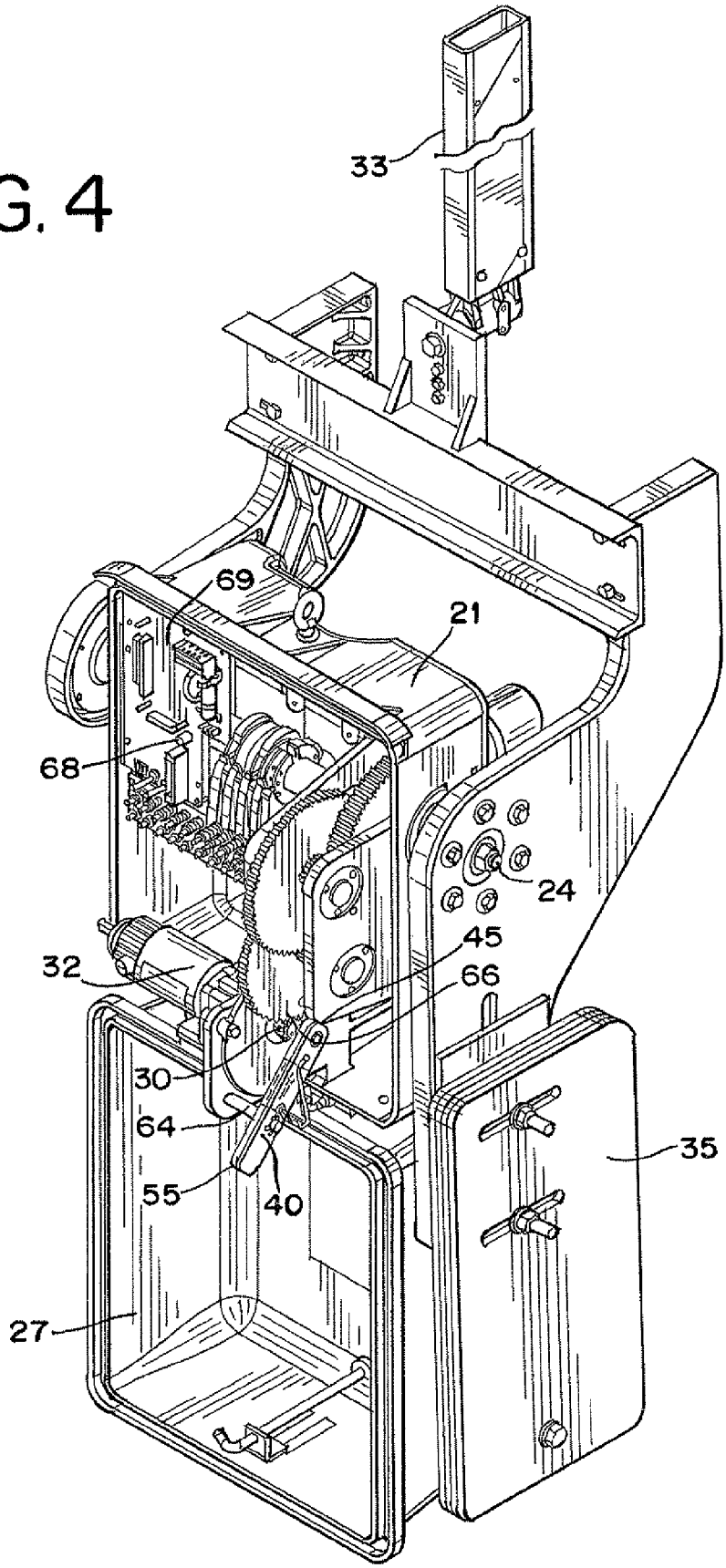
FIG. 4 is an elevational view illustrating a gate control box with the lock bar shown in FIG. 3 installed on the end of the motor shaft in accordance with the present invention.

Preferably, lock bar 40 has some indicia 53 to indicate how the orientation of the lock bar will limit movement of the gate 33 that is attached to the shaft 24 (FIG. 4) of the gate control box 21. This is because the clutch assembly 42 may limit rotation of the gate 33 to only one direction, as discussed above. For example, one side 54 of the lock bar may have indicia to the effect "keeps gate down" when lock bar 40 is oriented with side 54 up. An opposite side 57 may have indicia to the effect "keeps gate up" when lock bar 40 is oriented with side 57 up. Thus, a maintainer using lock bar 40 will know to orient the lock bar 40 in the orientation with side 54 up, as shown in FIG. 3, to keep the gate 33 down during maintenance, or to orient the lock bar with side 57 up to keep the gate 33 up.

Figure 5:
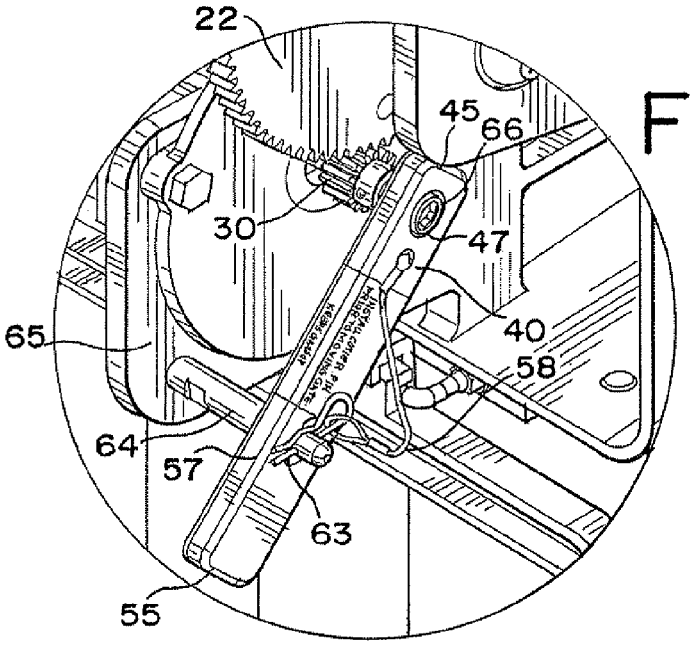
FIG. 5 is an enlarged elevational view illustrating the lock bar shown in FIGS. 3 and 4 installed on the end of the motor shaft in a first orientation to keep the gate up during maintenance in accordance with the present invention.

As can be seen in FIG. 5, a maintainer can install the lock bar 40 in a first orientation with side 57 in an upward orientation by sliding the oblong hole 52 in the bar over a reaction pin 64 that extends from a motor adaptor plate 65. At the same time, the internal female hexagonal surface 47 of the hub 46 near the first end 45 of the lock bar 40 slides over a corresponding male hexagonal surface on a motor output shaft 66 that extends outwardly from the pinion gear 30. The lock bar 40 can then secured to the reaction pin 64 by means of the hairpin 63 on the tether or the lanyard 58. Of course, other means of restricting movement the lock bar 40 will be apparent to those skilled in the art. For example, lock bar 40 may simply limit its movement by coming to rest on some portion of the housing 21 or some other portion of the apparatus.

The oblong or slotted hole 52 provides for off-center clearance in case the distance from the hexagonal motor shaft 66 and the reaction pin 64 is not uniform in all motor drive mechanisms. Thus, slotted hole 52 is preferably designed for ample longitudinal clearance between motor shaft 66 and reaction pin 64, as well ample transverse clearance, such as in case the motor shaft 66 or the reaction pin is slightly bent, or the like. Ample clearance provided by slotted hole 52 therefore makes installation of the lock bar 40 easier.

Figure 6:
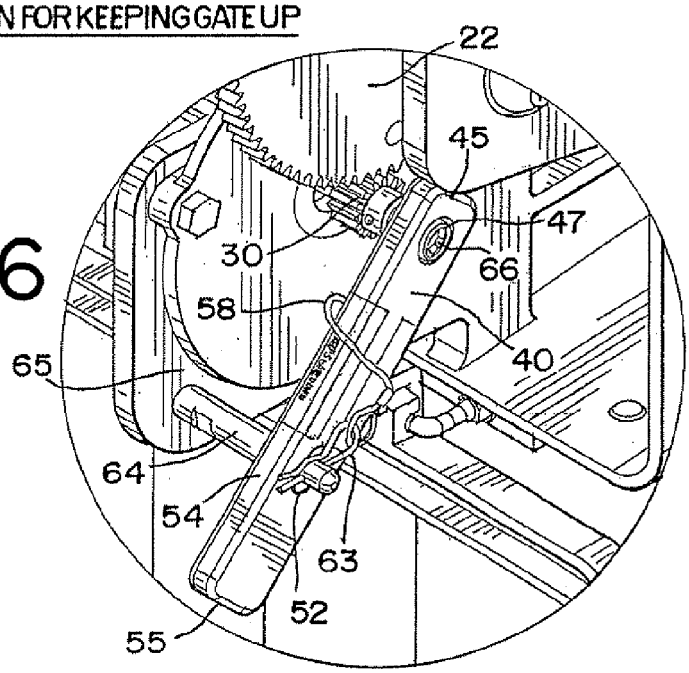
FIG. 6 is an enlarged elevational view illustrating the lock bar shown in FIGS. 3-5 installed on the end of the motor shaft in a second orientation to keep the gate down during maintenance also in accordance with the present invention.

Once the lock bar 40 is installed on the reaction pin 64 and the output shaft 66 of the motor 32, the maintainer can then press a maintenance button 68 on an electrical printed circuit board (PCB) 69 in the housing of the gate control box 21 to power the gate arm 33 to the down or horizontal position. As soon as the maintainer releases the maintenance button 68, the gate 33 will stay in this position due to the lock feature of the bearing/clutch 42 of the lock bar 40. Due to the clutch design, the gate 33 can only move one direction. If any force is applied in the opposite direction, the clutch 42 will lock and prevent movement in the opposite direction. The lock bar 40 thus prevents upward movement of the gate 33 when installed in the orientation shown in FIG. 6, i.e., keeps the gate in a down position, such as during maintenance.

FIG. 5 illustrates the lock bar 40 installed in a second orientation with side 54 in an upward orientation to prevent downward movement of the gate 33, i.e., keeps the gate in an up position. This second orientation of FIG. 6 differs from the first orientation of FIG. 5 in that the lock bar 40 has been rotated 180 degrees about its longitudinal axis into the second orientation shown in FIG. 6 before installation on the reaction pin 64 and the motor output shaft 66.

A significant advantage of the lock bar 40 of the present invention is that the lock bar can be installed prior to any need for the warning gate 33 to be locked in the desired direction. For example, if a new crossing gate is being installed, or if the gate arm 33 has been broken off and needs replacement, due to gravity of the counterweights 35 at the opposite end, the gate will be in the vertical or up position.

Another feature of the lock bar 40 can be utilized during adjustment of the counterweights 35 on the gate 33. If the ratcheting lock bar 40 is installed 180 degrees from the position above, downward movement will be restricted. This can be used when the maintainer is changing or setting up the horizontal and vertical torque on the gate mechanism 22. The procedure is as follows. The lock bar 40 is installed as described above, the gate 33 is powered to the vertical position and gate control is removed. The gate 33 would normally power down when gate control is removed. However, the clutch bearing 42 of the lock bar 40 prevents the gate 33 from lowering. The maintainer can then adjust the counterweights 35 and remove the lock bar 40 when finished.

The lock bar 40 is preferably elongated between the first and second ends 45 and 55 such that the lock bar cannot be inadvertently left in place when attempting to close the cover 27 of the gate control box 21 after maintenance procedures have been completed. To this end and as can be appreciated in the drawing figures, the length of the lock bar 40 prevents the cover 27 of the gate control box 21 from being closed when the lock bar is installed in either of the orientations shown in FIGS. 5 or 6. Thus, the lock bar 40 cannot be inadvertently left installed on the gear drive mechanism, thereby limiting or preventing movement of the gate 33 after completion of maintenance.

Figure 7:
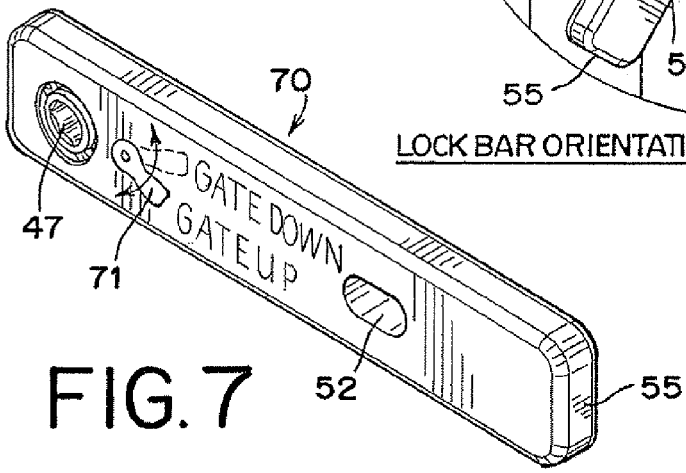
FIG. 7 is a perspective view of an alternative embodiment of the lock bar which includes a selector lever that determines whether the gate will be kept up or down, also in accordance with the present invention.

FIG. 7 illustrates another embodiment of a lock bar 70. Lock bar 70 is similar to the previously described lock bar 40, except that lock bar 70 includes a selector lever 71 to select the direction, clockwise or counterclockwise, of permitted movement of the ratcheting mechanism or clutch assembly 42. For example, in a first position, selector lever will keep the gate 33 down and in a second position, selector lever 71 will keep the gate 33 up. This embodiment of lock bar 70 has an advantage over lock bar 40 in that lock bar 70 does not need to be removed and reinstalled on the motor drive assembly in an opposite orientation to limit movement in an opposite direction. Instead, selector lever 71 is moved to its opposite position.

While particular embodiments of the invention have been shown and described, it will be obvious to those skilled in the art that changes and modifications may be made therein without departing from the invention in its broader aspects.

The invention claimed is:

1. A lock bar for temporary installation on a portion of a motor drive mechanism of a railroad warning gate to temporarily retain the railroad warning gate in a raised position or in a lowered position, said lock bar comprising:

a rigid elongated body portion extending between a first end and a second end and having first and second sides;

a clutch mechanism disposed in the rigid elongated body portion intermediate the first end and the second end of the elongated body portion; and said clutch mechanism having an internally disposed female engagement surface for engaging a similarly shaped male portion of the motor drive mechanism when the rigid elongated body portion is temporarily fixed to the motor drive mechanism with its first and second sides in a given orientation such that the railroad warning gate is permitted to rotate in one direction but is restricted from rotation in an opposite direction, and said clutch mechanism also engaging a portion of the motor drive mechanism when the rigid elongated body portion is temporarily fixed to the motor drive mechanism with the orientation of said sides substantially reversed such that said warning gate is permitted to rotate in said opposite direction but is restricted from rotation in said one direction, said clutch mechanism receiving the portion of the motor drive mechanism of the railroad warning gate in either orientation of the first or second sides of the latch bar.

2. The lock bar in accordance with claim 1, wherein said internally disposed female engagement surface of the clutch mechanism comprises an hexagonal surface and said similarly shaped male portion of the motor drive mechanism includes a hexagonal shaft, said internal hexagonal female surface of the clutch mechanism receives said hexagonal shaft of said portion of the motor drive mechanism in either orientation of said sides of the latch bar.

3. The lock bar in accordance with claim 1, further comprising indicia disposed on said first side for indicating a first position that the warning gate will be retained in if the rigid elongated body portion is temporarily fixed on the motor drive mechanism with said first side in a generally upright orientation.

4. The lock bar in accordance with claim 3, further comprising indicia disposed on said second side for indicating a second position that the warning gate will be retained in if the rigid elongated body portion is temporarily fixed on the motor drive mechanism with said second side in a generally upright orientation.

5. The lock bar in accordance with claim 4, wherein the first position that the railroad warning gate will be retained in is an up position and the second position that the railroad warning gate will be retained in is a down position.

6. The lock bar in accordance with claim 1, wherein the motor drive mechanism includes a pin, said lock bar further comprising an aperture defined through the rigid elongated body portion, the aperture suited for receiving the pin therethrough to hold the rigid elongated body portion in engagement with the motor drive mechanism.

7. The lock bar in accordance with claim 6, said aperture comprising an oblong slot.

8. The lock bar in accordance with claim 6, said lock bar further comprising a lanyard, a first end of the lanyard secured to the rigid elongated body portion, a second end of the lanyard including means to mate the lanyard with the pin to secure the lock bar about the pin.

9. The lock bar in accordance with claim 8, the means at the second end of the lanyard to secure the lanyard to the pin comprising a hairpin or a cotter key.

10. The lock bar in accordance with claim 1, the motor drive mechanism including a housing with a cover for enclosing the motor drive mechanism, and said rigid elongated body portion is of sufficient length between said first and second ends to prevent closure of the cover of the housing while the rigid elongated body portion remains fixed to the motor drive mechanism.

11. The lock bar in accordance with claim 1, further comprising means for selecting the direction of rotational movement permitted by said clutch mechanism.

12. The lock bar in accordance with claim 11, wherein said means for selecting the rotational movement permitted by said clutch mechanism is a selector lever, said selector lever moveable to a first position that retains the railroad warning gate in an up position, and said selector lever moveable to a second position that retains the railroad warning gate in a down position.

13. The lock bar in accordance with claim 1, wherein said internally disposed female engagement surface of the clutch mechanism comprises a surface in the shape of a polygon and said similarly-shaped male portion of the motor drive mechanism includes a shaft also in the shape of a polygon of the same type as the internal female engagement surface, said internal polygon-shaped female surface of the clutch mechanism receives said polygon-shaped shaft of said portion of the motor drive mechanism in either orientation of said sides of the latch bar.

14. A lock bar for temporary installation on a portion of a motor drive mechanism of a railroad warning gate to temporarily retain the railroad warning gate in a raised position or in a lowered position, said lock bar comprising:

a rigid elongated body portion extending between a first end and a second end;

a clutch mechanism disposed in the rigid elongated body intermediate the first end and the second end of the elongated body portion, said clutch mechanism permitting rotational movement in one direction but restricting rotational movement in an opposite direction;

said clutch mechanism engaging a portion of said motor drive mechanism when the lock bar is temporarily fixed thereon such that the railroad warning gate is permitted to move in one direction but is restricted from movement in the opposite direction;

wherein said clutch mechanism comprises an internal hexagonal female surface and said portion of the motor drive mechanism includes a hexagonal shaft, said internal hexagonal female surface of the clutch mechanism receives said hexagonal shaft of said portion of said motor drive mechanism when said latch bar is temporarily fixed to said motor drive mechanism.

* * * * *